United States Patent [19]

Hudson et al.

[11] Patent Number: 5,035,212

[45] Date of Patent: Jul. 30, 1991

[54] ENGINE FLOW RESTRICTION CONTROL

[75] Inventors: Gregory L. Hudson, Brimfield, Ill.; Khaled M. Issa, Raleigh, N.C.; Randall R. Richards, Chillicothe; William L. Sprick, Peoria, both of Ill.

[73] Assignee: Caterpillar Inc., Peoria, Ill.

[21] Appl. No.: 502,901

[22] Filed: Apr. 2, 1990

[51] Int. Cl.[5] ..... F02D 9/06; F02D 31/00

[52] U.S. Cl. ..... 123/323; 123/376

[58] Field of Search ..... 123/323, 376, 403

[56] References Cited

U.S. PATENT DOCUMENTS

| | | | |
|---|---|---|---|
| 3,430,436 | 3/1969 | Bader et al. | 60/13 |
| 3,577,727 | 5/1971 | Warren | 123/323 |
| 3,934,412 | 1/1976 | Masaki et al. | 60/288 |
| 4,254,752 | 3/1981 | Friddell et al. | 123/323 |

FOREIGN PATENT DOCUMENTS

| | | | |
|---|---|---|---|
| 0138237 | 8/1983 | Japan | 123/376 |

*Primary Examiner*—Tony M. Argenbright

*Assistant Examiner*—Robert E. Mates

*Attorney, Agent, or Firm*—Larry G. Cain

[57] ABSTRACT

The design and construction of present engines have generally not compensated for white smoke during start up and cold operating conditions where incomplete combustion occurs. The present invention overcomes these problems by using a control system adapted to be used with the engine and positioned between a restrictor valve and a throttle. The restrictor valve restricts the flow of one of the intake air and the exhaust. A mechanical linkage is connected between the throttle and the valve. The linkage moves a shaft and a plate relative to the throttle high idle position and low idle position respectively. A first lever has a slot therein and is rotatably attached to the shaft and a second lever is fixedly attached to the shaft and has a pin being generally positioned in the center of the slot. The slot allows the first lever to move slightly in either direction relative to the position of the second lever without varying the position of the plate between the generally closed position and the opened position.

17 Claims, 5 Drawing Sheets

ENGINE FLOW RESTRICTION CONTROL

TECHNICAL FIELD

This invention relates generally to engines and more particularly to the reduction of white smoke emitted from the engine.

BACKGROUND ART

Many engines, during the start up period, emit an over abundance of white smoke. White smoke is normally caused by incomplete combustion within the combustion chambers of the engine. For example, especially during start up, the cylinder or liner, the piston, the head and the other components in contact with the combustion chamber are cold. The cool configuration of the components extinguish the flame before burning is complete. As the piston moves from the intake stroke through the compression stroke, the temperature in the combustion chamber and the components in contact with the combustion chamber become warmer. At or near the top of the compression stroke, fuel is injected into the combustion chamber as small droplets of fuel and a portion of the mixture is rapidly burned. The remainder of the unburned small droplets of fuel is exhausted during the exhaust stroke as white smoke. The combination of the cool components and the incomplete cold combustion causes an excessive amount of white smoke to be exhausted from the combustion chamber and engine. As continued combustion takes place, the components are heated, the combustion becomes more complete increasing efficiency and white smoke is reduced. To overcome the start up problem, many engines are equipped with block coolant heaters. These heaters are electrically operated, draw a high current and require shore power to heat the electrical coils therein.

In some applications of high performance engines due to the high coolant efficiency, the temperature at idling condition within the combustion chamber components become cool enough to cause white smoke to occur. One example of white smoke at idling condition has been found to occur during marine pleasure craft trolling conditions. Attempts have been made to eliminate the white smoke by increasing the temperature of the coolant and eliminating the cool conditions in the combustion chamber. Such attempts have shown that the reaction time or responsiveness of such components used to control the temperatures is too slow and results in sporadic uncontrollable white smoke. The coolant temperature control systems are found to function properly under steady state condition but fail to compensate for rapidly changing conditions.

DISCLOSURE OF THE INVENTION

In one aspect of the invention, an engine includes a cylinder head having at least one intake passage and one exhaust passage therein and at least a single combustion chamber which is in fluid communication with the passages. A fuel system of the engine has a portion thereof in fluid communication with the combustion chamber. The fuel system includes a throttle being movable between a low idle position and a high idle position. An exhaust system of the engine includes an exhaust manifold having a passage therein. The passage in the exhaust manifold is in fluid communication with one of the passages in the cylinder head and a flow of intake air enters the combustion chamber and a flow of exhaust originating in the combustion chamber passes through the passages in the cylinder head and in the exhaust manifold. The invention comprises means for restricting the one of the intake air flow and the exhaust flow. A control system interconnects the throttle and the means for restricting. The control system includes a mechanical linkage between the throttle and the means for restricting. The linkage has a preestablished length and movingly positions the restricted position of the means for restricting one of the intake air flow and the exhaust flow in general correspondence with the low idle position.

In another aspect of the invention, a control system is adapted for use in an engine having at least a single combustion system and an intake system having at least one intake passage therein and being connected to the combustion chamber. An exhaust system of the engine has at least one exhaust passage therein and is connected to the combustion chamber. A fuel system of the engine is connected to the combustion chamber and has a throttle movable between a low idle position and a high idle position. A flow of intake air entering the combustion chamber and a flow of exhaust exiting the combustion chamber passes through one of the intake passage and the exhaust passage. The invention comprises a valve connected to one of the exhaust system and the intake system. The valve includes a housing having a through passage therein. The passage is in fluid connection with one of intake passage and the exhaust passage and has the one of the intake air flow and the exhaust flow passing therethrough. A shaft is rotatably positioned in the housing and a plate is fixedly attached to the shaft. The plate is positioned in the passage and is movable between an opened position and a closed position. A mechanical linkage is connected to the throttle and the shaft. The linkage has a preestablished length and movingly positions the plate to the restricted position corresponding to the low idle position and the plate to the opened position generally to the corresponding high idle position respectively.

BEST MODE FOR CARRYING OUT THE INVENTION

Figure 1:
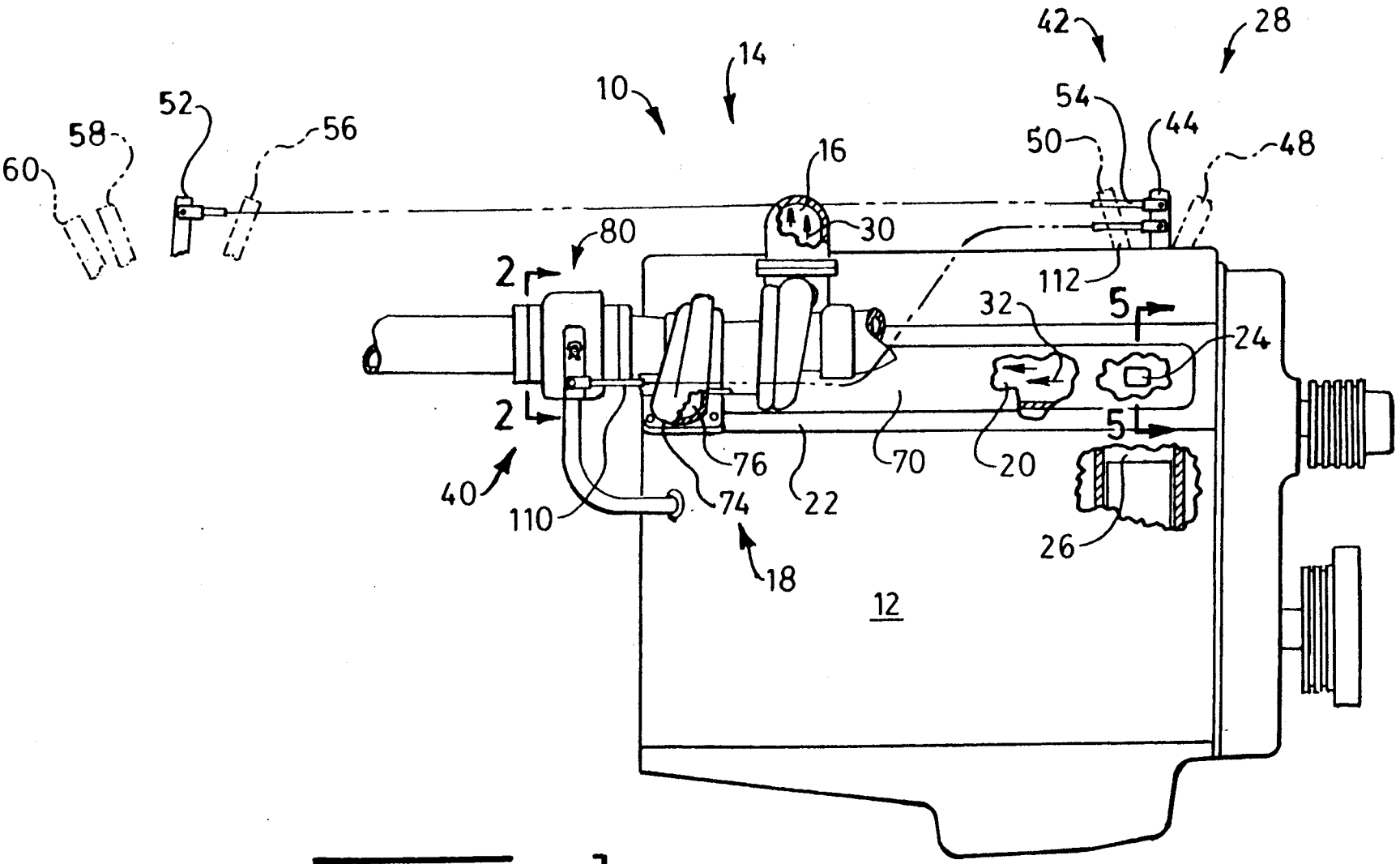
FIG. 1 is a side view of an engine with sections broken away and including an embodiment of the present invention.
Figure 2:
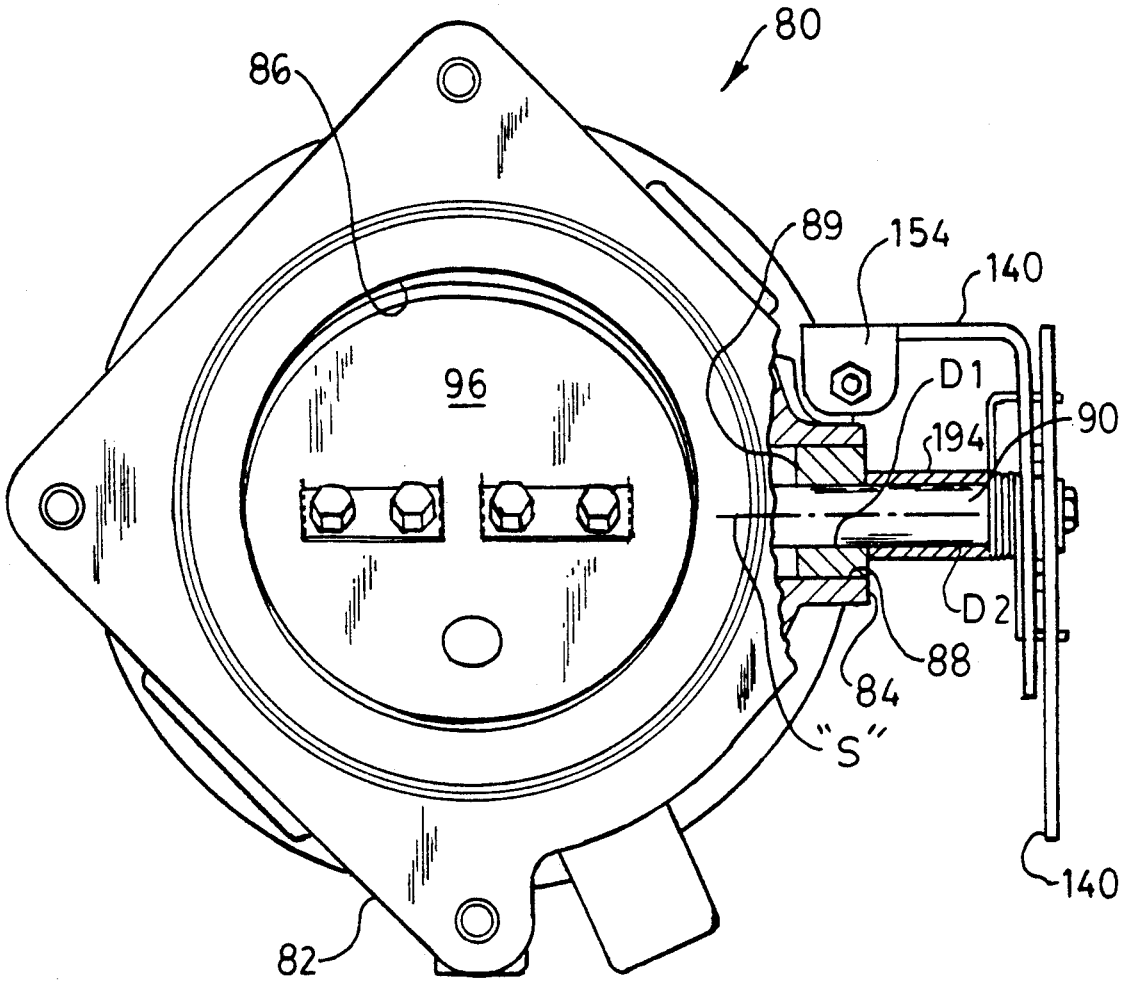
FIG. 2 is an enlarged end view of a valve of the present invention taken along line 2—2 of FIG. 1 with a portion broken away to show the relationship of a shaft and a bearing.
Figure 3:
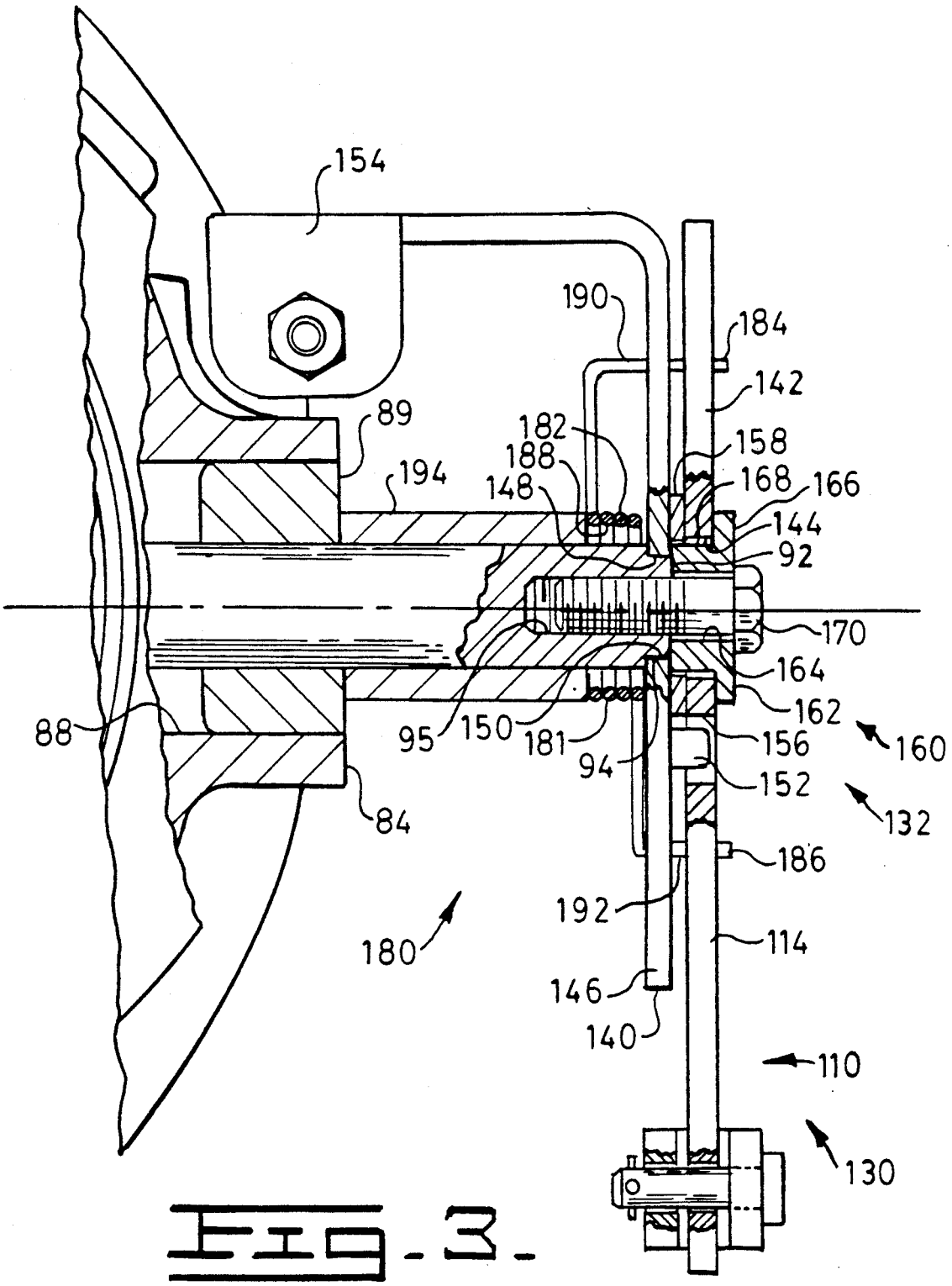
FIG. 3 is a practically sectioned and enlarged side view of the valve of FIG. 2 and a portion of a control system.
Figure 4:
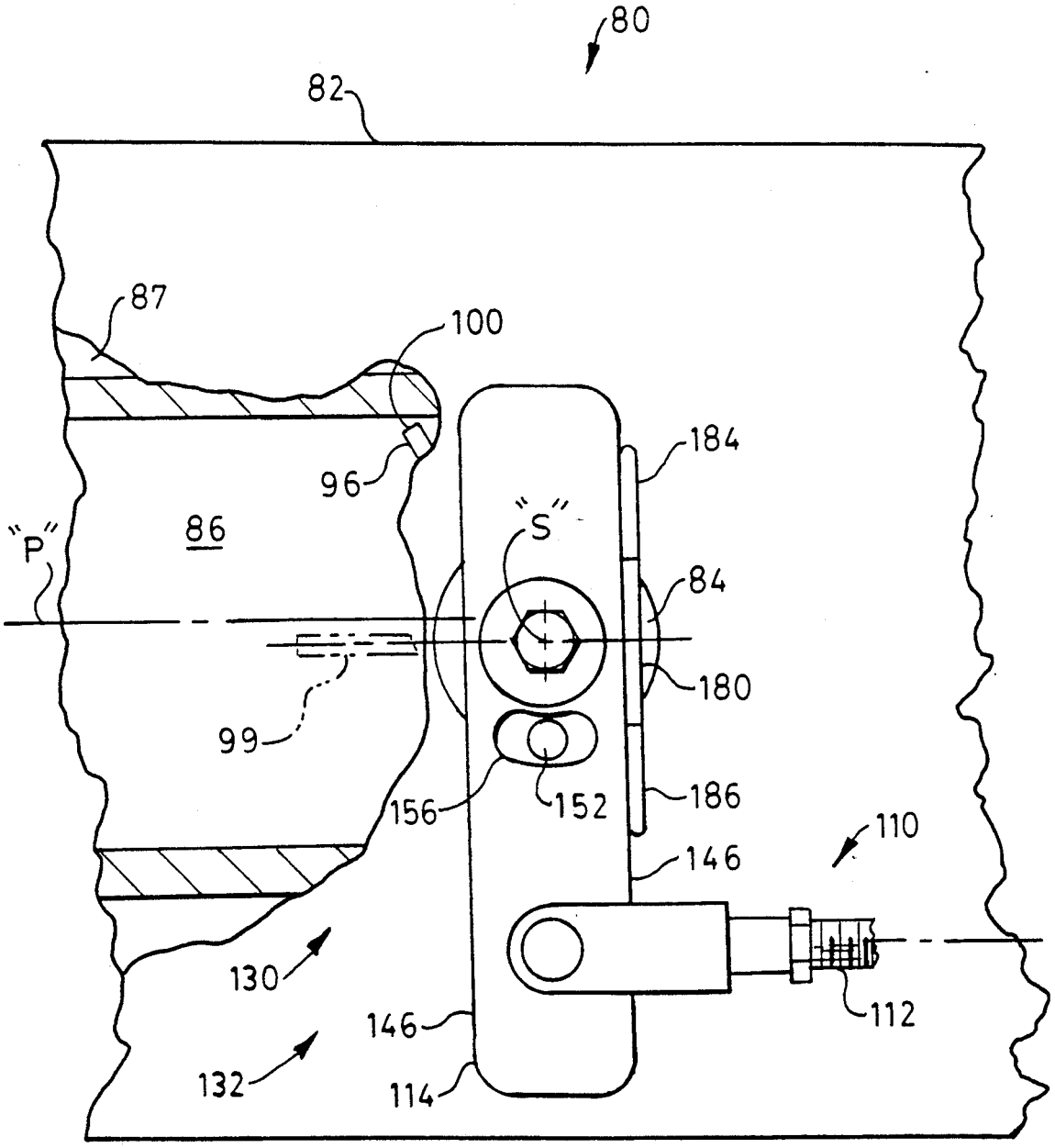
FIG. 4 is an enlarged side view of the valve of FIG. 3 with a portion broken away to show the relative position of a plate and a portion of the control system.
Figure 5:
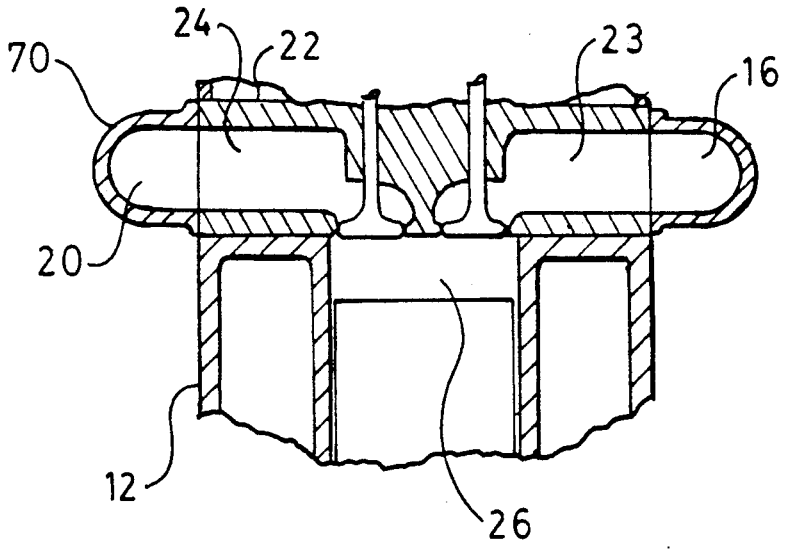
FIG. 5 is an enlarged sectional view of a portion of the engine taken along line 5—5 of FIG. 1.

Referring to the drawings, a control system 10 has been adapted for use with an engine 12. The engine 12 is of a conventional design and includes an intake system 14 having at least one intake passage 16 therein, and an exhaust system 18 having at least one exhaust passage 20 therein. The engine 12 further includes a cylinder head 22 having at least one intake passage 23 and at least one exhaust passage 24 therein, of which only one is shown in FIG. 5, at least a single combustion chamber 26 is in fluid communication with the passages 23,24 and a fuel system 28, of which only a portion is shown. The intake passage 23 is in fluid flow relationship to the intake passage 16 and the exhaust passage 24 is in fluid flow relationship to the exhaust passage 20. During operation of the engine 12, the combustion chamber 26 has a flow of intake air, designated by the arrows 30, which passes through the passage 16 and enters into the combustion chamber 26. After combustion occurs in the combustion chamber 26, the exhaust gas, designated by the arrows 32, is expended therefrom, into the passage 24 and through the passage 20. Means 40 for restricting one of the intake air flow 30 and the exhaust flow 32 is attached to the corresponding one of the intake system 14 and the exhaust system 18. In this application, the means 40 for restricting is connected to the exhaust system 18, but could be connected to the intake system 16. The means 40 for restricting is connected to the intake system in a similar manner to that described herein for connecting to the exhaust system.

The fuel system 28 is of a conventional design and includes a lever 44 movable between an opened position 48 in which the maximum fuel enters the combustion chamber 26 of the engine 12 and a closed position 50 in which fuel is prevented from entering the combustion chamber 26 of the engine 12. The lever 44 is modulatable between the opened position 48 and the closed position 50. The lever 44 is connected to a throttle lever 52 by a flexible cable 54 in a conventional manner or as an alternative a plurality of levers and links or, as another alternative, a hydraulic servo system could be used. The throttle 52 is movable between a high idle position 56 through a low idle position 58 and to a shutoff position 60. The high idle position 56 corresponds to the opened position 48 of the lever 44 and the shutoff position 60 corresponds to the closed position 50.

The exhaust system 18 further includes an exhaust manifold 70 attached to the cylinder head 22. The manifold 70 includes the passage 20. In this particular application, a turbocharger 74 having an exhaust passage 76 therein is attached to the exhaust manifold 70. The exhaust passage 76 is in fluid communication with the passage 20. As an alternative, the turbocharger 74 could be omitted.

The means 40 for restricting one of the fluid flows 30,32 includes a valve 80 connected to the turbocharger 74 or, as an alternative, the exhaust manifold 70. The valve 80 includes a housing 82 having an external surface 84 and a through passage 86 having an axis "P". The housing 82, in this application, includes an inner reservoir 87 for water cooling. As an alternative, the housing 82 could include optional cooling fins or not have any cooling accessories. The passage 86 is connected in fluid flow relationship to the passages 20,24 and 76 in the exhaust system 18. A pair of axially aligned bores 88, of which only one is shown, are positioned in the housing 82 offset from the axis "P"; the bores 88 are normal to the axis "P". At least one of the bores 88 extends through the housing 82 and exits at the external surface 84. A pair of bearings 89, of which only one is shown, have a preestablished inner diameter D1 and are fixedly fitted in the bores 88. A shaft 90 is rotatably positioned in the pair of bearings 89. The shaft 90 has a preestablished diameter D2. The relationship between the preestablished diameters D1 and D2 provides a preestablished clearance of about 0.18 mm to insure that the shaft 90 is rotatable under all operating conditions of the engine 12. The shaft 90 further includes an axis "S" and an end 92 which extends beyond the external surface 84. The shaft further includes a pair of flat portions 94 extending from the end 92 a preestablished distance on the shaft 90, which in this application is about 2.6 mm. A threaded hole 95 is generally centered on the axis "S" and extends axially from the end 92 into the shaft 90 a preestablished distance, which in this application is about 20 mm. An elliptical plate 96 is positioned in the passage 86 preventing the plate 96 from becoming perpendicular to the axis "P" and going over center. The plate 96 is attached to the shaft 90 in a conventional manner such as being bolted to a flat on the shaft 90. The plate 96 and the shaft 90 are controllably rotatable between an opened position 99 and a generally restricting position 100. The physical relationship between the plate 96 and the passage 86 are critical to the efficient operation of the valve 80. For example, the relationship between the plate 96 and the passage 86 must provide sufficient clearance for a buildup of carbon during engine 12 operation. On the other hand, the clearance must be tight enough to insure that sufficient backpressure and heat is developed in the combustion chamber 26 to generally eliminate white smoke.

The control system 10 includes a mechanical linkage 110 connected between one of the lever 44 and the throttle 52 and the means 40 for restricting. In this application, the linkage 110 is connected between the lever 44 and the valve 80. The linkage 110 has a preestablished length and movingly positions the plate 96 to the restricting position 100 generally corresponding with the low idle position 58 of the throttle 52. The linkage 110 also positions the opened position 99 of the plate 96 to a position intermediate the low idle position 58 and the high idle position 56 of the throttle 52. A push pull cable 112 is attached at one end to the lever 44 in a conventional manner. Another end of the cable 112 is attached to a first lever 114 by a conventional manner such as a yoke assembly which is threadably attached to the cable 112. The first lever 114 has a hole 118 therein positioned near one of its ends and is rotatably attached to the shaft 90. The control system 10 further includes means 130 for allowing the flow of exhaust 32 to move the plate 96 a preestablished distance intermediate the restricting position 100 and the opened position 99.

The means 130 for allowing the flow of exhaust 32 to move the plate 96 a preestablished distance includes a lost motion mechanism 132 which includes the first lever 114 and a second lever 140 fixedly attached near the end 92 of the shaft 90. The first lever 114 has a preestablished width, which in this application is approximately 25 mm, and a pair of edges 142. The first lever 114 further includes a through hole 144 positioned generally equal distances between the ends of the first lever 114. The second lever 140 has a preestablished width, which in this application is approximately 25 mm, and has a pair of edges 146. The second lever 140 is positioned generally intermediate its ends on the shaft 90. The second lever 140 further includes a through hole 148 generally centered between the ends of the second lever 140. The hole 148 includes a pair of circular portions, not shown, interconnected by a pair of flat portions 150. When the second lever 140 is attached to the shaft 90, the flat portions 94 on the shaft 90 align with the flat portions 150 and prevent the second lever 140 from rotating on the shaft 90. A pin 152 is fixedly attached to the second lever 140 intermediate one of its ends and the through hole 148 and a stop member 154 is attached to the second lever 140 near the end furthest from the pin 152. The first lever 114 further includes a preestablished generally arcuate slot 156. The slot 156 is positioned in the first lever 114 so that when the first lever 114 is positioned in operating relationship to the shaft 90 and the second lever 140, the pin 152 is positioned in the slot 156. A spacer 158 is positioned about the shaft 90 between the first lever 114 and the second lever 140. A means 160 for retaining the first lever 114 to the shaft 90 removably attaches the first lever 114 to the shaft 90. The retainer means 160 includes a generally cylindrical retainer 162 having a through hole 164 generally centered therein, a flange 166 at one end and a bearing surface 168 intermediate the flange 166 and the other end of the retainer 162. The bearing surface 168 is sized to fit into the through hole 144 in the first lever 114 and provides rotational clearance therebetween. The retainer means 160 further includes a threaded fastener 170 inserted through the hole 164, threaded into the threaded hole 95 in the shaft 90 and secures the retainer 162 to the end 92 of the shaft 90 positioning the first and second levers 114,140 in axial relationship to each other. The means 130 for allowing the flow of exhaust 32 to move the plate 96 a preestablished distance further includes means 180 for aligning the first lever 114 and the second lever 140. The means 180 for aligning in this application is a torsional spring 181. The spring 181 includes a body 182 and a pair of pre-formed end portions 184,186. The spring body 182 is made up of a wire wound around an anvil and has a preestablished inner diameter 188. The inner diameter 188 is slightly larger than the diameter D2 of the shaft 90. One end portion 184 has a hook portion 190 extending tangentially from the inner diameter 188 and is positioned a preestablished distance from the body 182. The other end portion 186 has a hook portion 192 extending tangentially from the inner diameter 188. The end portions 184, 186 are aligned in a plain extending from the complimentary edges 142,146 of the first and second levers 114,140. The end portion 186 is also positioned a preestablished distance from the body. In the present application, the preestablished distances of the end portions 184,186 are equal to each other. A spacer 194 is positioned over the shaft and in abutment with the external surface 84. The body 182 of the spring 181 is positioned over the shaft 90 and abuts the spacer 194. The end portion 184 is positioned in contact with one of the edges 142 of the first lever 114 and one of the edges 146 of the second lever 140 above the shaft 90. The other end portion 186 of the spring 181 is positioned in contact with the same edge 142 of the first lever 114 and the same edge 146 of the second lever 140 below the shaft 90. Thus, the first lever 114 and the second lever 140 are aligned and the pin 152 is center in the slot 156 when the flow 32 is not acting on the plate 96.

INDUSTRIAL APPLICABILITY

In actual operation, such as marine pleasure craft operations, the exhaust restrictor is used to prevent white smoke. When the engine 12 is started, the throttle 52 is in the low idle position and the plate 96 is positioned in the generally restricting position 100. Thus, as the exhaust gas 32 is emitted from the combustion chamber 26, the plate 96 restricts the flow of exhaust 32. The restriction causes a backpressure in the combustion chamber 26 which more rapidly increases the heating of the components associated with the combustion chamber 26. The heating of the components more rapidly reduces incomplete combustion which reduces white smoke. As the throttle 52 is moved toward the high idle position 56, the lever 44 is moved toward the opened position 48 and the mechanical linkage 110 moves the plate 96 from the generally restricting position 100 toward the opened position 99. The mechanical linkage 110 is adjusted so that the plate 96 is normally in the generally restricting position 100 when the engine 12 is operating at about 600 RPM and is normally in the opened position 99 when the engine 12 is operating at about 1200 RPM and above.

During some operations of the marine pleasure craft, such as trolling, the coolant flow through the engine 12 cools the combustion chamber 26 and its related components to the point where white smoke will occur. The control system 10 compensates for this over cooling of the engine 12 and prevents white smoke. For example, the operator moves the throttle 52 to the low idle position 58, resulting in the lever 44 moving intermediate the closed position 50 and the opened position 48. Since the mechanical linkage 110 is connected to the lever 44, the cable 112 moves the plate 96 into the generally restricting position 100. The exhaust 32 is restricted from exiting the combustion chamber 26 maintaining the combustion chamber 26 and the components associated therewith at a temperature sufficient to prevent incomplete combustion and reduces white smoke. In some trolling operations, the engine 12 is required to operate below the normal low idle position 58 of about 600 RPM. During these operations, the engine 12 is required to operate at about 500 RPM. Thus, one of the uses of the slot 156 comes into play. For example, the throttle 52 is moved slightly past the low idle position 58 and the cable 54 moves the lever 44 slightly past its normal position corresponding to the low idle position 58. The cable 112 exerts a force on the first lever 114. The first lever 114 which is rotatably connected to the shaft 90 and the plate 96 exerts a force on one of the end portions 184,186 of the spring 180. The first lever 114 is allowed to move slightly relative to the second lever 140. As the slot 156 continues to move, the pin 152 eventually contacts the end of the slot 156 and causes the second lever 140 to move changing the position of the plate 96. Thus, the first lever 114 is allowed to move slightly without effecting the position of the shaft 90 and the plate 96. A similar condition can also arise when the marine engine 12 is required to have a higher high idle position 56 than is normal. For example, the engine 12 speed is to be set above the normal 2800 RPM. Under the above conditions, the first lever 114 is allowed to move slightly without effecting the position of the shaft 90 and the plate 96. Thus, the slot 156 allows the first lever 114 to move slightly in either direction without changing the relative position of the shaft 90 and the plate 96. The slot 156 length or configuration can be varied to change the operating characteristics of the engine 12. For example, the length of the slot 156 will determine when the mechanical linkage 110 manually moves the position of the plate 96. When the stop 154 is in contact with the housing 82 of the valve 80, the plate 96 is prevented from moving over center past the opened position 99.

It has been theorized that when the control system 10 is used in conjunction with the intake system 14 the reduction of intake air 30 will cause engine 12 to react similar to a lean burn engine 12. Thus, the increased heat in the combustion chamber 26 will result in increased temperature and result in reduced white smoke.

The present invention overcomes the deficiencies of the prior art by eliminating the need for expensive shore operated coolant heaters. Furthermore, the present invention provides a manual, inexpensive directly connected control system 10 between the throttle 52 and the valve 80. The lost motion mechanism 132 allows variation in the throttle setting to be really made without requiring timely adjustments to the linkage 110.

Other aspects, objects and advantages of this invention can be obtained from the study of the drawings, the disclosure and the appended claims.

We claim:

1. An engine including a cylinder head having at least one intake passage and one exhaust passage therein, at least a single combustion chamber in fluid communication with the passages, a fuel system having a portion thereof in fluid communication with the combustion chamber, said fuel system including a throttle being movable between a low idle position and a high idle position and an exhaust system including an exhaust manifold having a passage therein, said passage being in fluid communication with one of the passages in the cylinder head, a flow of intake air entering the combustion chamber, a flow of exhaust originating in the combustion chamber and passing through the passages in the cylinder head and the exhaust manifold, comprising:

means for restricting one of said intake air flow and the exhaust flow, said means having an opened position and a restricted position; and a control system interconnecting said throttle and said means for restricting, said control system including a mechanical linkage between the throttle and the means for restricting, said linkage having a preestablished length and movingly positioning the restricted position of the means for restricting one of the intake air flow and the exhaust flow in a position generally corresponding with the low idle position of the throttle.

2. The engine of claim 1 wherein said means for restricting includes a valve connected to the exhaust manifold, said valve including a housing, a through passage in the housing, said passage being in fluid communication with the flow of exhaust and a shaft rotatable positioned in the housing and extending through the passage, and a plate fixedly attached to the shaft and positioned in the passage.

3. The engine of claim 2 wherein said plate being controllably rotatable with the shaft between the opened position and the restricted position.

4. The engine of claim 2 wherein said mechanical linkage having a preestablished length and movingly positioning the plate into the restricted position corresponding to the low idle position of the throttle and the plate into the opened position intermediate the low idle position and the high idle position of the throttle.

5. The engine of claim 3 wherein said control system further includes means for allowing the flow of exhaust to move the plate a preestablished distance intermediate the restricted position and the opened position.

6. The engine of claim 5 wherein said means for allowing the flow of exhaust to move the plate includes a lost motion mechanism allowing the plate to be moved by the flow of exhaust.

7. The engine of claim 6 wherein said means for allowing the flow of exhaust to move the plate includes a second lever fixedly attached to the shaft, a first lever rotatably attached to the shaft and fixedly attached to the linkage and a means for aligning the first lever and the second lever.

8. The engine of claim 7 wherein said means for aligning the first lever and the second lever includes a torsional spring position about the shaft.

9. The engine of claim 7 wherein said means for allowing the flow of exhaust to move the plate further includes a through hole in the first lever, means for retaining fixedly attached to the shaft and positioned in the through hole, said retaining means including a retainer being fixedly attached to the shaft.

10. The engine of claim 7 wherein said means for allowing the flow of exhaust to move the plate further includes a pin fixedly attached to the second shaft, a slot in the first shaft and the pin being generally centrally positioned in the slot when the flow is not acting on the plate.

11. A control system adapted for use in an engine having at least a single combustion chamber, an intake system having at least one intake passage therein connected to the combustion chamber, an exhaust system having at least one exhaust passage therein connected to the combustion chamber, a fuel system connected to the combustion chamber and having a throttle movable between a low idle position and a high idle position and a flow of intake air entering the combustion chamber and a flow of exhaust exiting the combustion chamber and passing through one of the intake passage and the exhaust passage, comprising:

a valve connected to one of the exhaust system and the intake system, said valve including a housing having a through passage therein, said passage being in fluid communication with one of the intake passage and the exhaust passage and having one of the intake air flow and the exhaust flow passing therethrough, a shaft rotatably positioned in the housing and a plate fixedly attached to the shaft, said plate positioned in the passage and being movable between an opened position and a restricted position; and a mechanical linkage connected to the throttle and the shaft, said linkage having a preestablished length and movingly positioning the plate in the restricted position in a position generally corresponding with the low idle position of the throttle and positioning the plate in the opened position in a position generally corresponding with the high idle position of the throttle respectively.

12. The control system of claim 11 wherein said system further includes means for allowing one of the intake flow and the exhaust flow to move the plate between the restricted position and the opened position.

13. The control system of claim 12 wherein said means for allowing one of the intake flow and the exhaust flow to move the plate includes a lost motion mechanism allowing the plate to be moved by one of the intake flow and the exhaust flow.

14. The control system of claim 13 wherein said means for allowing one of the intake flow and the exhaust flow to move the plate includes a second lever fixedly attached to the shaft, a first lever rotatably attached to the shaft and fixedly attached to the linkage and a means for aligning the first lever and the second lever.

15. The control system of claim 14 wherein said means for aligning the first lever and the second lever includes a torsional spring position about the shaft.

16. The control system of claim 14 wherein said means for allowing one of the intake air flow and the exhaust flow to move the plate further includes a bore in the first lever, means for fixedly retaining the levers to the shaft including a retainer having a bearing shaft thereon position in the bore.

17. The control system of claim 14 wherein said means for allowing one of the intake air flow and the exhaust flow to move the plate further includes a pin fixedly attached to the second shaft, a slot in the first lever and the pin being generally centrally positioned in the slot when one of the intake flow and the exhaust flow is not acting on the plate.

* * * * *